US007999222B2

(12) United States Patent
Shishika et al.

(10) Patent No.: US 7,999,222 B2
(45) Date of Patent: Aug. 16, 2011

(54) TIME-OF-FLIGHT MASS SPECTROMETER

(75) Inventors: Tsukasa Shishika, Mito (JP); Yasushi Terui, Tsuchiura (JP)

(73) Assignee: Hitachi High-Technologies Corporation, Tokyo (JP)

( * ) Notice: Subject to any disclaimer, the term of this patent is extended or adjusted under 35 U.S.C. 154(b) by 253 days.

(21) Appl. No.: 12/474,992

(22) Filed: May 29, 2009

(65) Prior Publication Data

US 2009/0294659 A1 Dec. 3, 2009

(30) Foreign Application Priority Data

May 30, 2008 (JP) ..... 2008-141818

(51) Int. Cl.
*H01J 49/00* (2006.01)

(52) U.S. Cl. ..... 250/287; 250/297; 313/103 R

(58) Field of Classification Search ..... 250/287
See application file for complete search history.

(56) References Cited

U.S. PATENT DOCUMENTS

| | | | | |
|---|---|---|---|---|
| 3,885,180 | A * | 5/1975 | Carts, Jr. | 313/103 R |
| 6,906,318 | B2 | 6/2005 | Bateman et al. | |
| 7,047,144 | B2 * | 5/2006 | Steiner | 702/64 |
| 7,564,043 | B2 * | 7/2009 | Hayashi et al. | 250/397 |
| 2004/0227070 | A1 | 11/2004 | Bateman et al. | |
| 2008/0116368 | A1 | 5/2008 | Uchiyama et al. | |
| 2008/0230686 | A1 * | 9/2008 | Suzuki et al. | 250/281 |

FOREIGN PATENT DOCUMENTS

| | | |
|---|---|---|
| JP | 2001-351565 | 12/2001 |
| JP | 2001-351566 | 12/2001 |
| JP | 2005-298603 | 10/2005 |

* cited by examiner

*Primary Examiner* — Phillip A Johnston
(74) *Attorney, Agent, or Firm* — Antonelli, Terry, Stout & Kraus, LLP.

(57) ABSTRACT

A time-of-flight mass spectrometer includes a detector and is adapted to measure the time it takes for an accelerated ion to reach the detector and thereby measure the mass of the ion. The time-of-flight mass spectrometer scans a voltage applied to an ion incident side surface of the detector in accordance with a mass to be measured. An electrode is provided between the detector and a space in which an ion flies. The time-of-flight mass spectrometer is capable of measuring ions of a wide range of masses with high detection efficiency by scanning a voltage applied to the electrode.

7 Claims, 3 Drawing Sheets

| TYPE | ENERGY | DETECTION EFFICIENCY |
|---|---|---|
| ELECTRON | 0.2keV to 2keV | 50 to 85 |
| | 2keV to 50keV | 10 to 60 |
| ION ($H^+$,$He^+$,$Ar^+$) (MONOVALENT ION HAVING LOW MASS) | 0.5keV to 2keV | 5 to 58 |
| | 2keV to 50keV | 60 to 85 |
| | 50keV to 200keV | 4 to 60 |

TIME-OF-FLIGHT MASS SPECTROMETER

BACKGROUND OF THE INVENTION

1. Field of the Invention

The present invention relates to a time-of-flight mass spectrometer for separating ions according to mass based on the time of flight of the ions.

2. Description of the Related Art

Mass spectrometry is one method for structurally analyzing biological molecules. In mass spectrometry, the substances constituting a biological molecule are identified based on the masses of the substances. Recent years have seen a rising need for measurement of functionally modified proteins such as those modified by phosphoric acids, sugar chains, or the like. In the current field of mass spectrometry, time-of-flight mass spectrometers are most frequently used. The time-of-flight mass spectrometers are designed to measure the flight time it takes for accelerated ions to reach a detector and thereby to measure the masses of the ions. The most frequently used detectors for the time-of-flight mass spectrometers are micro channel plates (MCP), and methods have been proposed to improve their detection efficiency (refer to U.S. Pat. No. 6,906,318, for example).

A wide variety of mass spectrometers such as a quadrupole mass spectrometer and a magnetic sector mass spectrometer have been used in the mass spectrometry field. These mass spectrometers, however, have some restrictions in the size of the mass spectrometers, the strength of electromagnetic fields required for the mass spectrometers, the control voltage applied to the mass spectrometers, and the resolution of the mass spectrometers. Thus, ranges of masses that the mass spectrometers can measure are limited. In addition, a conventional mass spectrometer separates ions by mass, then accelerates the ions with a constant voltage and measures the masses of the ions to improve sensitivity of a measurement of ions having large masses (refer to, for example, JP-A-2001-351565, JP-A-2001-351566 and JP-A-2005-298603).

SUMMARY OF THE INVENTION

The efficiency of detection performed by a detector for mass spectrometry may vary depending on an acceleration voltage. In the case where ions of a wide range of masses are measured, the conventional acceleration method performed with a constant voltage before the measurement of the masses of ions may result in a reduction in the efficiency of detection of ions having small masses and ions having large masses. A conventional time-of-flight mass spectrometer uses an electric field to accelerate ions. Thus, when the conventional time-of-flight mass spectrometer changes an electric field applied in a space in which an ion flies, concentration of energy of the ion on the surface of a detector may vary. As a result, an ion resolution of the conventional time-of-flight mass spectrometer, accuracy of the measurement performed by the conventional time-of-flight mass spectrometer, and the like may be reduced. In addition, the efficiency of detection of ions having large masses by the conventional time-of-flight mass spectrometer may be reduced.

An object of the present invention is to provide a time-of-flight mass spectrometer capable of measuring ions of a wide range of masses with high detection efficiency.

According to an aspect of the present invention, the time-of-flight mass spectrometer scans a voltage applied to the surface of a detector in accordance with a mass to be measured.

According to another aspect of the present invention, an electrode is provided between the detector and a space in which an ion flies, and a voltage applied to the electrode is scanned.

The present invention provides a time-of-flight mass spectrometer capable of highly efficiently measuring ions of a wide range of masses.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

Embodiments of the present invention are described below with reference to the accompanying drawings.

Figure 1:
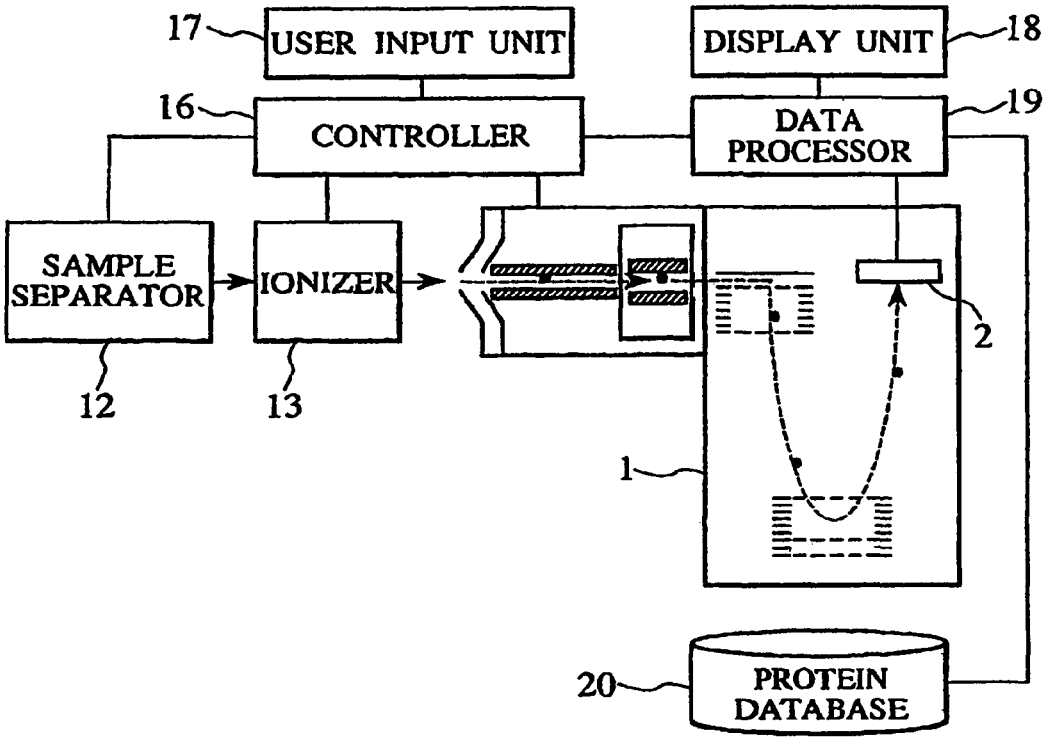
FIG. 1 is a diagram showing an example of the configuration of a time-of-flight mass spectrometer according to a first embodiment of the present invention.

FIG. 1 shows a time-of-flight mass spectrometry system according to a first embodiment of the present invention. Reference numeral 1 denotes a time-of-flight mass spectrometer. Reference numeral 2 denotes a detector included in the time-of-flight mass spectrometer 1.

The time-of-flight mass spectrometry system includes a sample separator 12 and an ionizer 13. The sample separator 12 separates a sample such as a biological sample into fragments. The ionizer 13 ionizes the sample fragments separated by the sample separator 12. The detector 2 is a feature of the present embodiment. As the sample separator 12, a gas chromatograph (GC), a liquid chromatograph (LC), a capillary electrophoresis (CE) or the like may be used. The ionized sample enters the time-of-flight mass spectrometer 1 from the ionizer 13. The sample separator 12, the ionizer 13, the time-of-flight mass spectrometer 1 and the detector 2 are connected with both of a controller 16 and a data processor 19 by a network or a signal line. In addition, the sample separator 12, the ionizer 13, the time-of-flight mass spectrometer 1 and the detector 2 are connected with a user input unit 17, a display unit 18 and a protein data base 20 via the controller 16 and the data processor 19 as shown in FIG. 1.

When the ionizer 13 is connected with the LC or the CE, the ionizer 13 may perform matrix-assisted laser desorption/ionization (MALDI), electrospray ionization (ESI), atmospheric pressure chemical ionization (APCI), atmospheric pressure photoionization (APPI), atmospheric pressure matrix-assisted laser desorption/ionization (AP-MALDI) and the like. When the ionizer 13 is connected with the GC, the ionizer 13 may perform electron impact ionization (EI), chemical ionization (CI), direct injection (DI) and the like in addition to the aforementioned ionizations.

The detector 2 shown in FIG. 1 is of hybrid type and an orthogonal axis detector. The detector 2 according to the present embodiment may be a coaxial detector, a coaxial reflector type detector and an orthogonal reflector type detector.

An ion optical system provided on the upstream side of the time-of-flight mass spectrometer 1 may use a multipole lens. Alternatively, the ion optical system may use multipole ion guides arranged at multiple stages. Alternatively, the ion optical system may use ring-shaped lenses arranged at multiple stages.

Figure 2:
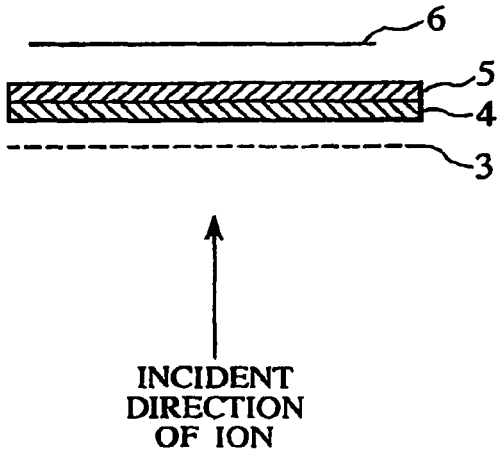
FIG. 2 is a diagram showing an example of the configuration of a detector included in the time-of-flight mass spectrometer according to the first embodiment.

FIG. 2 shows the configuration of the detector 2. The detector 2 includes an ion incident side electrode 4, an ion outgoing side electrode 5 and an anode electrode 6. The anode electrode 6 is adapted to detect a secondary electron. The detector 2 may include a time-of-flight (TOF) optical system electrode 3 depending on the arrangement of the ion optical system provided on the upstream side of the time-of-flight mass spectrometer 1.

In a typical time-of-flight mass spectrometer, voltages are applied to a TOF optical system electrode 3 and an ion incident side electrode 4 to ensure that a potential at the TOF optical system electrode 3 is the same as a potential at the ion incident side electrode 4. According to the present embodiment, a voltage is applied to the ion incident side electrode 4 of the detector 2. The voltage applied to the ion incident side electrode 4 reaccelerates an ion between the TOF optical system electrode 3 and the ion incident side electrode 4 to improve the efficiency of detection of an ion having a large mass. In this case, it is preferable that the TOF optical system electrode 3 be composed of a mesh electrode to prevent an electric field generated between the TOF optical system electrode 3 and the ion incident side electrode 4 from penetrating into the TOF optical system electrode 3.

In order to measure a positive ion, a positive pulse voltage of several kV is applied to cause an ion to start to fly. Then, a voltage equal to or lower than the pulse voltage is applied in a space in which the ion flies. A potential difference between the pulse voltage and the voltage applied in the space accelerates the ion.

The accelerated ion is incident on the detector 2. It is preferable that a mesh electrode is provided between two adjacent ones of the electrodes of the detector 2 to prevent the electric field from penetrating into the TOF optical system electrode 3. This is not applied to the case where a change in the electric field has a small effect on the trajectory of the ion.

The voltage applied to the TOF optical system electrode 3 may be equal to a ground potential or be several kV depending on the configuration of the time-of-flight mass spectrometer 1. When the voltage applied to the TOF optical system electrode 3 is equal to the ground potential, the voltage to be scanned and a period of time for applying the voltage to be scanned are changed based on energy (generated due to the voltage (acceleration voltage) applied for the acceleration) of the ion incident on the detector 2 and based on the velocity of the ion.

When a pulse voltage of several kV is applied to the TOF optical system electrode 3, the scanning of the voltage starts with the acceleration voltage. Then, the scanning of the voltage continues to be performed until the voltage reaches the maximum voltage obtained based on the maximum mass.

For example, when a positive ion is accelerated by means of a voltage of +1 kV, and a voltage of −3 kV is applied in a space in which the ion flies, the total acceleration voltage is 4 kV. In this case, the initial voltage applied to the ion incident side electrode of the detector 2 is set to −3 kV, which is the same voltage applied in the space. In order to measure an ion having a large mass, the voltage applied to the ion incident side electrode of the detector 2 is changed to increase the acceleration voltage. For example, the voltage applied to the ion incident side electrode of the detector 2 is changed from −3 kV to −10 kV.

The TOF optical system electrode 3 is preferably located in the time-of-flight mass spectrometer and at a location on which the energy of the ion is concentrated. The mass of the reaccelerated ion can be corrected based on a time calculated based on the velocity of the ion accelerated by means of the voltage (reacceleration voltage) applied for the reacceleration and on a distance over which the ion flies.

$$mv^2/2=qV \qquad \text{Formula 1}$$

where m is the mass of an ion, v is the velocity of the ion, q is the valence of the ion, and V is the acceleration voltage.

$$t=L/v \qquad \text{Formula 2}$$

where t is the time for the correction, and L is the distance between the TOF optical system electrode and a surface electrode of the detector.

If the TOF optical system electrode 3 is provided at a location other than the location on which the energy of the ion is concentrated, a variation in the ion energy generated at the TOF optical system electrode 3 is large and a correction factor is complicated. Therefore, the TOF optical system electrode 3 is preferably located in the time-of-flight mass spectrometer and at the location on which the energy of the ion is concentrated.

The start time and end time of the scanning of the voltage and the voltage depend on a range of the mass of an ion to be measured and on whether the ion to be measured is a positive ion or a negative ion. Thus, it is necessary that the start time, the end time and the voltage be set in consideration of a time constant of the rising edge of a high applied voltage and a time constant of the falling edge of the high applied voltage.

Assume for example that ions fly over a distance of two meters in the space by means of a voltage of −4 kV in order to measure ions having a mass of 50 to 25000. In that case, the measurement starts when a time of 15 μs elapses after the ions start flying. The measurement ends when a time of 360 μs elapses after the ions start flying. The voltage is scanned during a period of time from a time point of 16 μs to a time point of 360 μs, and the voltage is set back to the initial voltage within a period of time from the time point of 360 μs to a time point of 375 μs. In this case, each of the time points indicates the time point after the start of the flight of the ions.

Figures 3, 4:
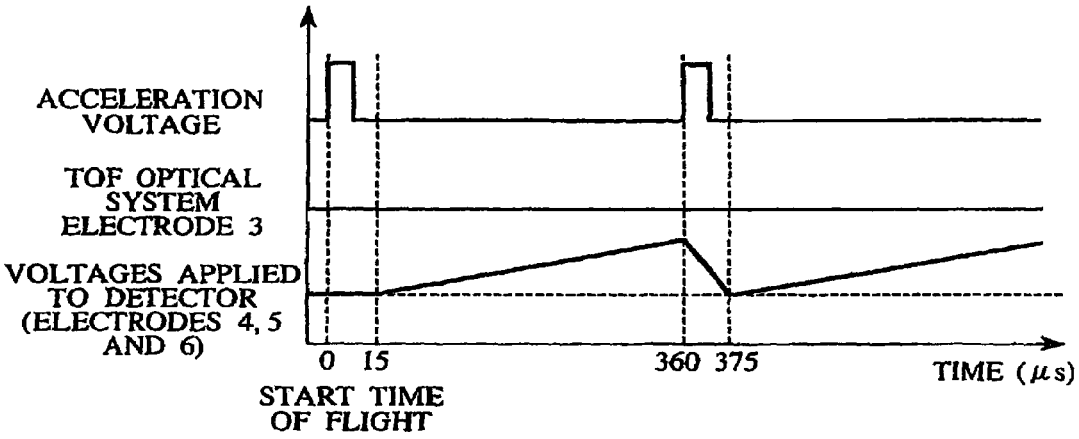
FIG. 3 is a graph showing an example of a sequence of voltage application.
FIG. 4 is a diagram showing an example of release of a secondary electron with respect to energy of an incident electron.

FIG. 3 is a diagram showing an example of a sequence of the voltage application according to the present embodiment. The voltages applied to the detector need to be changed in response to the voltage applied to the incident part of the detector 2. Although the voltages applied to the detector 2 are illustrated in the same control sequence shown in FIG. 3, the voltages are actually applied to the respective parts of the detector 2.

Under typical use conditions, a voltage of approximately 1.5 kV to 2.5 kV is applied between the ion incident side electrode 4 and ion outgoing side electrode 5 of the detector 2. When a voltage of −3 kV is applied to the ion incident side electrode 4 of the detector 2 in order to measure a positive ion, a voltage of approximately −1 kV is applied to the ion outgoing side electrode 5 of the detector 2 and a voltage of approximately −500 V is applied to the anode electrode 6. When a voltage of +3 kV is applied to the ion incident side electrode 4 of the detector 2 in order to measure a negative ion, a voltage of +5 kV is applied to the ion outgoing side electrode 5 of the detector 2 and a voltage of +5.5 kV is applied to the anode electrode 6.

Figure 5:
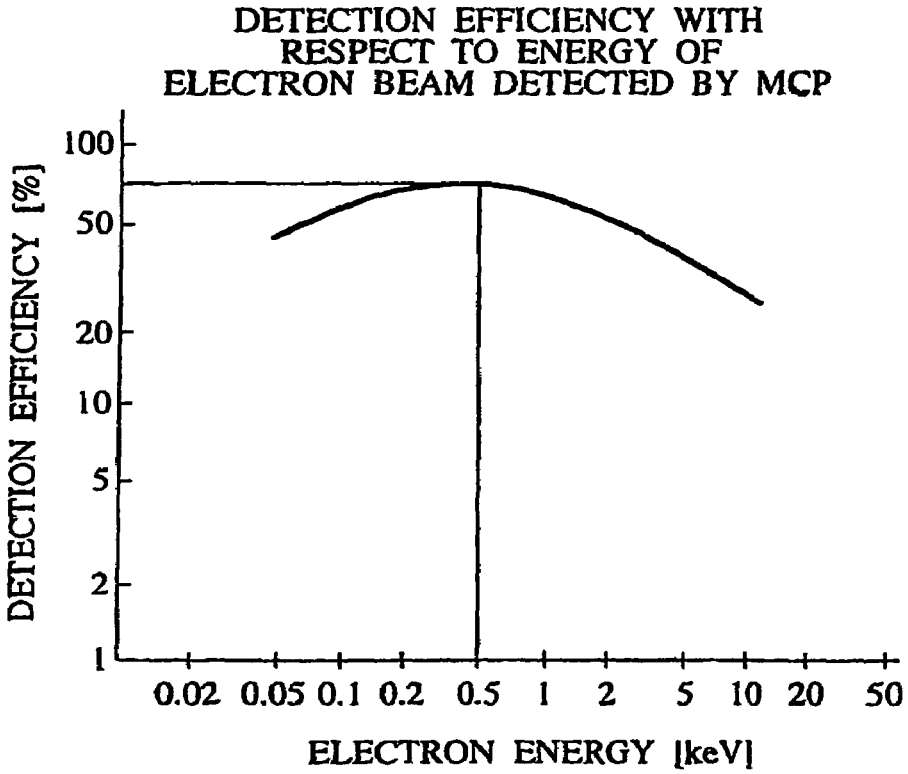
FIG. 5 is a graph showing an example of an efficiency of detection of an electron and an ion with respect to energy of an ion and electron that are incident to the detector.

FIGS. 4 and 5 show the relationship of the detection efficiency with respect to the energy of an electron incident on the TOF optical system electrode 3 and the energy of an ion incident on the TOF optical system electrode 3. FIG. 4 shows an example of a released secondary electron with respect to the energy of the incident electron. FIG. 5 shows an example of the efficiency of detection of an electron and an ion with respect to energy of an ion and electron that are incident to the detector.

Second Embodiment

Figure 6:
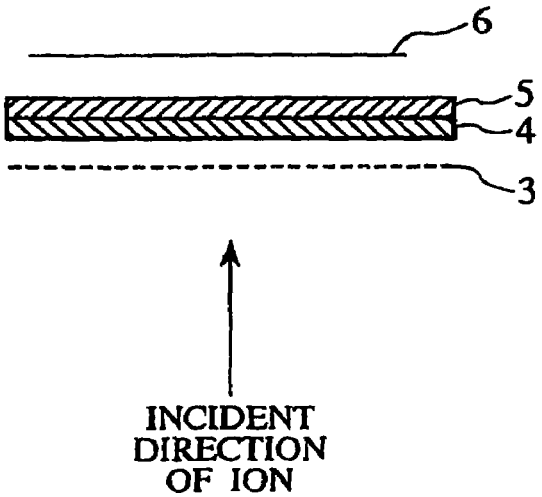
FIG. 6 is a diagram showing an example of the configuration of a detector included in a time-of-flight mass spectrometer according to a second embodiment of the present invention.

FIG. 6 shows the configuration of a detector included in a time-of-flight mass spectrometer according to a second embodiment of the present invention. The detector includes an ion incident side electrode 4, an ion outgoing side electrode 5 and an anode electrode 6 in this order from the ion incident side. The anode electrode 6 is adapted to detect a secondary electron. The detector according to the second embodiment also has a voltage application electrode 7 provided on the ion incident side of the detector 2 with respect to the ion incident side electrode 4.

A time-of-flight mass spectrometry system according to the second embodiment includes a sample separator 12 and an ionizer 13. The sample separator 12 separates a sample such as a biological sample. The ionizer 13 ionizes the sample separated by the sample separator 12. The detector is a feature of the present embodiment. As the sample separator 12, a gas chromatograph (GC), a liquid chromatograph (LC), a capillary electrophoresis (CE) or the like may be used. The ionized sample enters the time-of-flight mass spectrometer 1 from the ionizer 13.

When the ionizer 13 is connected with the LC or the CE, the ionizer 13 may perform matrix-assisted laser desorption/ionization (MALDI), electrospray ionization (ESI), atmospheric pressure chemical ionization (APCI), atmospheric pressure photoionization (APPI), atmospheric pressure matrix-assisted laser desorption/ionization (AP-MALDI) and the like. When the ionizer 13 is connected with the GC, the ionizer 13 may perform electron impact ionization (EI), chemical ionization (CI), direct injection (DI) and the like in addition to the aforementioned ionizations.

The detector shown in FIG. 6 is of hybrid type and an orthogonal axis detector. The detector according to the present embodiment may be a coaxial detector, a coaxial reflector type detector and an orthogonal reflector type detector.

In the second embodiment, the voltage application electrode 7, which is a similar to the TOF optical system electrode shown in FIG. 3, is added to the detector and located on the ion incident side of the ion incident side electrode 4. Thus, the detector according to the second embodiment is capable of measuring an ion having a large mass, as in the first embodiment.

It is preferable that the voltage application electrode 7 be located in the time-of-flight mass spectrometer and at a location on which the energy of an ion is concentrated. In addition, it is preferable that a potential applied to the voltage application electrode 7 before voltage scanning be equal to a voltage applied in a space in which an ion flies.

Third Embodiment

A third embodiment of the present invention pertains to a method of applying acceleration voltages. The time of flight, the mass and the time for the correction are calculated based on the formulas shown in the first embodiment. Based on the difference between the mass of an electron and the mass of a hydrogen ion and the difference between the mass of the electron and the mass of an argon ion, the mass ratio is in a range of 2000 to 80000. Based on Formula 1, the velocity is proportional to the one-half power of a value obtained by dividing the energy by the mass. Thus, the velocity ratio is in a range of 40 to 250.

In order to detect a mass of several tens to several ten thousands with the optimal sensitivity, it is necessary that the acceleration voltage be set to be in a range of 200 V to 10 kV. When a mass larger than the abovementioned mass is to be detected, it is desirable that the acceleration voltage be set to several tens kV.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A time-of-flight mass spectrometer comprising a detector and adapted to measure the time it takes for an accelerated ion to reach the detector and thereby measure the mass of the ion, wherein a voltage applied to an ion incident side surface of the detector is scanned.

2. The time-of-flight mass spectrometer according to claim 1, wherein the detector has an ion incident side electrode, and the voltage applied to the ion incident side surface of the detector is a voltage applied to the ion incident side electrode.

3. The time-of-flight mass spectrometer according to claim 2, wherein the voltage applied to the ion incident side electrode is scanned in accordance with a mass to be measured.

4. A time-of-flight mass spectrometer comprising a detector and adapted to measure the time it takes for an accelerated ion to reach the detector and thereby measure the mass of the ion, wherein the detector has an ion incident side electrode and a voltage application electrode, the voltage application electrode is located on an ion incident side of the detector with respect to the ion incident side electrode, and a voltage applied to the voltage application electrode is scanned.

5. The time-of-flight mass spectrometer according to claim 3, wherein the voltage applied to the voltage application electrode is scanned in accordance with a mass to be measured.

6. The time-of-flight mass spectrometer according to claim 1, wherein the applied voltage is in a range of 200 V to 10 kV.

7. The time-of-flight mass spectrometer according to claim 1, wherein the detector has an ion incident side electrode, an ion outgoing side electrode and an anode electrode, the ion outgoing side electrode and the anode electrode being located on the side opposite to an ion incident side of the ion incident side electrode.

* * * * *